US009165527B2

(12) United States Patent
Baumgart

(10) Patent No.: US 9,165,527 B2
(45) Date of Patent: Oct. 20, 2015

(54) SYSTEM FOR DISPLAY OF IMAGES USING EXTENDED GREYSCALE BIT-DEPTH ON STANDARD DISPLAY DEVICES

(71) Applicant: John Baumgart, Hoffman Estates, IL (US)

(72) Inventor: John Baumgart, Hoffman Estates, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 178 days.

(21) Appl. No.: 13/868,325

(22) Filed: Apr. 23, 2013

(65) Prior Publication Data

US 2013/0307869 A1 Nov. 21, 2013

Related U.S. Application Data

(60) Provisional application No. 61/647,639, filed on May 16, 2012.

(51) Int. Cl.
*G09G 5/02* (2006.01)
*G09G 5/10* (2006.01)

(52) U.S. Cl.
CPC .. *G09G 5/02* (2013.01); *G09G 5/10* (2013.01); *G09G 2340/0428* (2013.01); *G09G 2340/06* (2013.01)

(58) Field of Classification Search
CPC ... G09G 5/02; G09G 5/10; G09G 2340/0428; G09G 2340/06
USPC ..... 345/589, 600, 601, 604
See application file for complete search history.

(56) References Cited

U.S. PATENT DOCUMENTS

| | | | | |
|---|---|---|---|---|
| 5,546,105 | A * | 8/1996 | Leak | 345/604 |
| 6,674,436 | B1 | 1/2004 | Dresevic et al. | |
| 6,791,609 | B2 | 9/2004 | Yamauchi et al. | |
| 8,045,614 | B2 * | 10/2011 | Gish et al. | 375/240.03 |
| 2005/0043614 | A1 * | 2/2005 | Huizenga et al. | 600/427 |
| 2007/0285516 | A1 * | 12/2007 | Brill et al. | 348/189 |
| 2009/0262055 | A1 * | 10/2009 | Bilger et al. | 345/89 |

* cited by examiner

*Primary Examiner* — Xiao Wu
*Assistant Examiner* — Chong Wu

(57) ABSTRACT

A system enhances reduced resolution grey scale luminance data for display on a monitor. An interface receives a pixel grey scale luminance value represented by a first number of bits exceeding a display monitor input bit length. A data processor indicates a difference comprising the number of bits. In response to the difference, the data processor derives R, G, B pixel luminance values by adjusting one or more of the R, G, B pixel luminance values to provide corrected R, G, B pixel luminance values representing the grey scale luminance value and at least one of the corrected R, G, B pixel luminance values is different from remaining ones of R, G, B pixel luminance values. The data processor outputs the corrected R, G, B pixel luminance values for display on R, G, B channels of the monitor.

11 Claims, 4 Drawing Sheets

Figure 2

203

| 205 | 207 | 209 | 211 | 213 | 215 | 217 | 219 | 221 |
|---|---|---|---|---|---|---|---|---|
| | | | | | | | error from 10-bit value | |
| 10-bit pix. | 8-bit trunc | fraction | Δr | Δg | Δb | total luminance | no fraction | w/fraction |
| 500 | 125 | 0.00 | 0 | 0 | 0 | 125.00 | 0.00 | 0.00 |
| 501 | 125 | 0.25 | 1 | 0 | 0 | 125.30 | 1.00 | -0.20 |
| 502 | 125 | 0.50 | 1 | 0 | 1 | 125.41 | 2.00 | 0.36 |
| 503 | 125 | 0.75 | 0 | 1 | 1 | 125.70 | 3.00 | 0.20 |
| 504 | 126 | 0.00 | 0 | 0 | 0 | 126.00 | 0.00 | 0.00 |
| 505 | 126 | 0.25 | 1 | 0 | 0 | 126.30 | 1.00 | -0.20 |
| 506 | 126 | 0.50 | 1 | 0 | 1 | 126.41 | 2.00 | 0.36 |
| 507 | 126 | 0.75 | 0 | 1 | 1 | 126.70 | 3.00 | 0.20 |

Figure 3

303

| 305 | 307 | 309 | 311 | 313 | 315 | 317 | 319 | 321 |
|---|---|---|---|---|---|---|---|---|
| | | | | | | | error value | from 10-bit |
| 10-bit pix. | 8-bit trunc | fraction | Δr | Δg | Δb | total luminance | no fraction | w/fraction |
| 500 | 125 | 0.00 | 0 | 0 | 0 | 125.00 | 0.00 | 0.00 |
| 501 | 125 | 0.25 | 5 | -1 | -6 | 125.25 | 1.00 | 0.00 |
| 502 | 125 | 0.50 | 4 | -1 | -1 | 125.50 | 2.00 | 0.00 |
| 503 | 125 | 0.75 | -4 | 2 | 7 | 125.75 | 3.00 | 0.00 |
| 504 | 126 | 0.00 | 0 | 0 | 0 | 126.00 | 0.00 | 0.00 |
| 505 | 126 | 0.25 | 5 | -1 | -6 | 126.25 | 1.00 | 0.00 |
| 506 | 126 | 0.50 | 4 | -1 | -1 | 126.50 | 2.00 | 0.00 |
| 507 | 126 | 0.75 | -4 | 2 | 7 | 126.75 | 3.00 | 0.00 |

SYSTEM FOR DISPLAY OF IMAGES USING EXTENDED GREYSCALE BIT-DEPTH ON STANDARD DISPLAY DEVICES

This is a non-provisional application of provisional application Ser. No. 61/647,639 filed May 16, 2012, by J. Baumgart.

FIELD OF THE INVENTION

This invention concerns a system for enhancing reduced resolution grey scale luminance data for display on a monitor.

BACKGROUND OF THE INVENTION

Images acquired in many systems used for radiological applications, including fluoroscopy, angiographic X-ray, mammography, computed tomography (CT), and magnetic resonance imaging (MRI) are typically represented with greater than 8 bits per pixel. While this extended bit depth is used for carrying out image processing without the loss of perceived image integrity, current displays used with these systems are usually 8-bit displays, requiring the precision of the displayed image to be down-sampled to 8 bits of precision per pixel. While most people viewing a greyscale image are not able to discern more than the 256 grey shades that an 8-bit pixel is able to provide, radiologists that spend large amounts of time viewing these images are often able to detect differences that could be represented by a 10-bit display. 10-bit display hardware, however, is relatively expensive compared with standard 8-bit display hardware. A system according to invention principles addresses this deficiency and related problems.

SUMMARY OF THE INVENTION

A system uses standard monitors capable of displaying colors represented by 8 bits of data per channel to display greyscale images that use more than 8 bits to represent the luminance intensity of a pixel. A system enhances reduced resolution grey scale luminance data for display on a monitor. An interface receives a pixel grey scale luminance value represented by a first number of bits exceeding a display monitor input bit length. A data processor indicates a difference comprising the number of bits. In response to the difference, the data processor derives R, G, B pixel luminance values by adjusting one or more of the R, G, B pixel luminance values to provide corrected R, G, B pixel luminance values representing the grey scale luminance value and at least one of the corrected R, G, B pixel luminance values is different from remaining ones of R, G, B pixel luminance values. The data processor outputs the corrected R, G, B pixel luminance values for display on R, G, B channels of the monitor

BRIEF DESCRIPTION OF THE DRAWING

FIG. 2 shows a Table illustrating how 10-bit pixel luminance values are displayed in comparison with display of pixel luminance values truncated to 8-bits, according to invention principles.

FIG. 3 shows a Table illustrating representation of pixel fractional luminance values when using an 8-bit greyscale monitor that does not show color shifting, according to invention principles.

DETAILED DESCRIPTION OF THE INVENTION

A system uses standard monitors capable of displaying colors represented by 8 bits of data per channel to display greyscale images that use more than 8 bits to represent the luminance intensity of a pixel.

Figure 1:
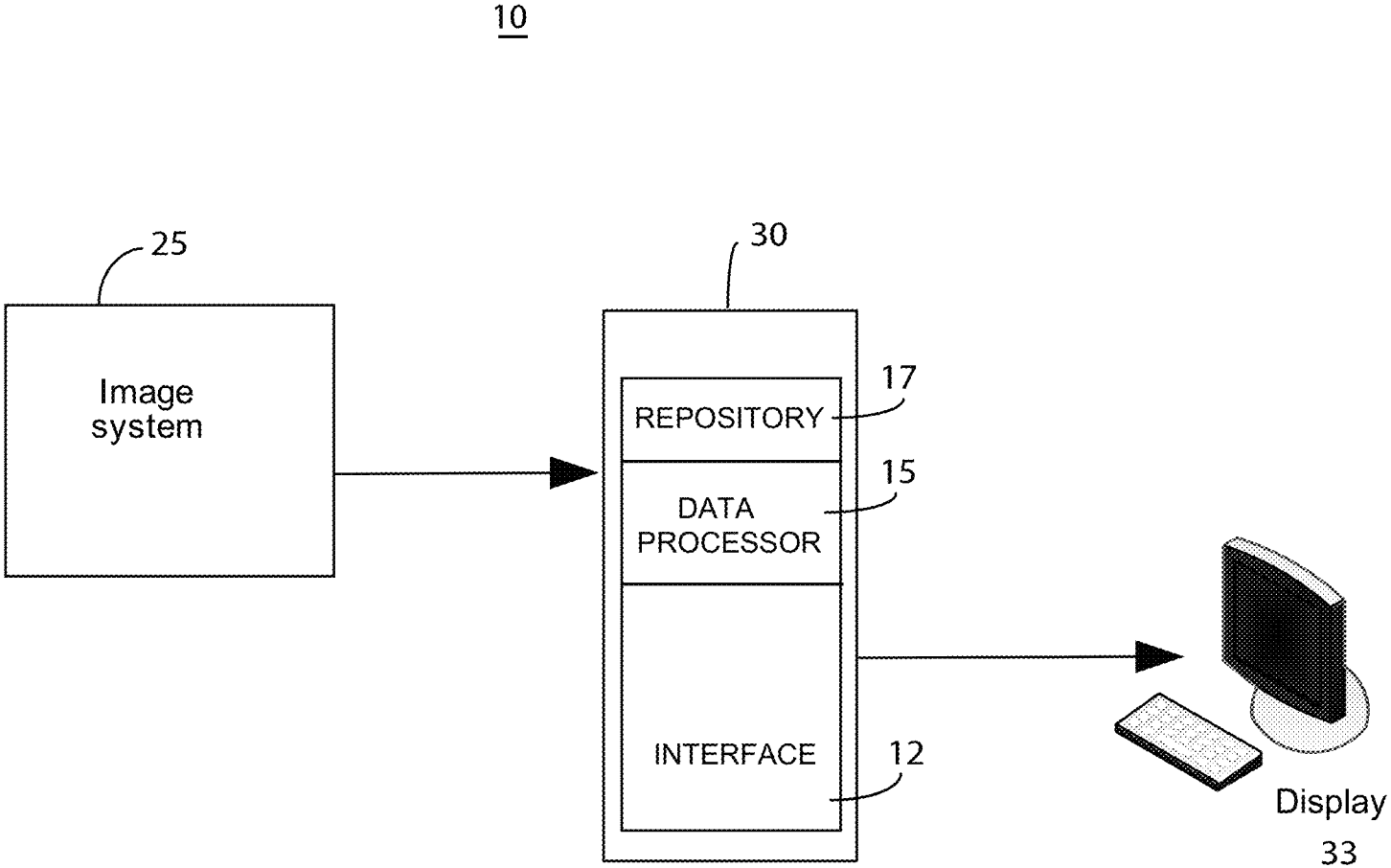
FIG. 1 shows a system enhancing reduced resolution grey scale luminance data for display on a monitor, according to invention principles.

FIG. 1 shows system 10 for enhancing reduced resolution grey scale luminance data for display on monitor 33. System 10 employs at least one processing device 30 for processing images acquired by imaging system 25 for display on monitor 33. Specifically, processing device 30 comprises at least one computer, server, microprocessor, programmed logic device or other processing device comprising repository 17, data processor 15 and interface 12.

System 10 presents an image represented by higher-precision luminance values in excess of 8-bits to a user using a standard 8-bit display system. It is known that the luminance of a non-linear gamma corrected pixel represented by a red, green, and blue component may be represented, for example, by:

$$L=0.3r+0.59g+0.11b$$

In known systems, grey values are displayed by using the same value in each of the red, green, and blue channels. System 10, in contrast, enables each color channel to vary by a small amount such that there is a difference in luminance, but the resulting color shift is not large enough to be detected by a human eye. The additional bits beyond 8 are advantageously considered to be a fraction of a grey shade and the color offset to use to achieve this fractional grey shade is calculated by finding values using the above equation for r, g, and b that give a sufficiently accurate value for L. When using a color monitor, these values are desirably as close to 0 as possible to avoid the perception of color shift. On a greyscale monitor that combines red, green, and blue channels to drive a pixel on a monitor, these values can have a wider range, since the display does not convey color information to the viewer.

Interface 12 receives a pixel grey scale luminance value represented by a first number of bits exceeding display monitor 33 input bit length. Data processor 15 represents a difference between the luminance value and a displayable bit value of the input bit length as a fraction of a grey scale level value of the input bit length. In response to the difference, data processor 15 derives R, G, B pixel luminance values by adjusting one or more of the R, G, B pixel luminance values to provide corrected R, G, B pixel luminance values representing the grey scale luminance value where at least one of the corrected R, G, B pixel luminance values is different from remaining ones of R, G, B pixel luminance values. Data processor 15 outputs the corrected R, G, B pixel luminance values for display on R, G, B channels of monitor 33.

FIG. 2 shows Table 203 illustrating how 10-bit pixel luminance values, for example, are displayed in comparison with display of pixel luminance values truncated to 8-bits. Column 207 shows uncorrected 8 bit pixel values comprising values (in decimal) corresponding to 10 bit pixel values of column 205 with corresponding error fraction of a grey scale level value (where 256 grey scale level values are represented by an 8 bit representation) shown in column 209 representing error involved in representing a 10 bit value of column 205 with the corresponding nearest 8 bit value of column 207.

System 10 advantageously represents the 10 bit grey scale pixel values of column 205 with the 8 bit pixel value of column 207 plus the R, G, B correction pixel bits of (Δr, Δg, Δb) of columns 211, 213 and 215 respectively. The additional Δr, Δg, Δb adjustment values of columns 211, 213 and 215 applied to R, G, B video channels respectively and change color imperceptibly but corrects for luminance. The system takes advantage of the fact that the human eye is relatively insensitive to color shade in comparison with sensitivity to luminance. The total luminance value of the corrected 8 bit pixel value is shown in column 217 with each total luminance value being calculated by adding the bit pixel value of each row of column 207 to the sum 0.3r+0.59g+0.11b where r, g, b are the bit values of the row in columns 211, 213 and 215 respectively. Column 219 shows number of bits of error (of a 10 bit value) involved in representing each 10 bit value of column 205 with the corresponding nearest uncorrected 8 bit value of column 207. Column 221 shows number of bits of error (of a 10 bit value) involved in representing each 10 bit value of column 205 with the corresponding nearest corrected 8 bit value of column 217. The system 10 correction substantially reduces luminance error as indicated by comparison of the values of columns 219 and 221.

Data processor 15 determines a difference between an input luminance value and a displayable bit value of an input bit length as indicated in columns 209 and 219. In response to the difference, processor 15 derives R, G, B pixel luminance values by allocating an additional bit to the displayable bit value for one or two of the R, G, B pixel luminance values as shown in columns 211, 213, 215 to provide corrected R, G, B pixel luminance values representing the grey scale luminance value (column 217). Processor 15 outputs corrected R, G, B pixel luminance values for display on monitor 33. In an example, 8 bit monitor 33 displays 256 grey shades if the red, green, and blue display channels are set to the same value and system 10 provides 1021 different shades of grey, which is nearly 10 bits of precision. There are 1021 shades rather than 1024 shades available since delta values as exemplified by columns 211, 213, 215 may not be added to the maximum value of 255 (values 255.25, 255.50 and 255.75 are not available). A 10-bit grey value of 502 would be displayed as r=126, g=125, b=126, for example.

In another embodiment, a more accurate representation of fractional values is possible when monitor 33 is an 8-bit greyscale monitor that does not show color shift and combines red, green, and blue channels to drive a pixel on a monitor. In this embodiment, Δr, Δg, Δb integer values for each color channel of columns 311, 313 and 315 are advantageously selected in accordance with the luminance equation to provide accurate luminance output with an error limited to 0.01. This provides sufficient precision to display luminance values of an image having approximately 14 bits of precision per pixel.

FIG. 3 shows a Table illustrating representation of pixel fractional luminance values when using an 8-bit greyscale monitor that does not show color shift. FIG. 3 shows Table 303 illustrating how 10-bit pixel luminance values, for example, are displayed in comparison with display of pixel luminance values truncated to 8-bits to provide approximately 14 bits of pixel luminance precision on a monitor 33 insensitive to color shift. Column 307 shows uncorrected 8 bit pixel values comprising approximate mid-point values (in decimal) corresponding to 10 bit pixel values of column 305 with corresponding error fraction of a grey scale level value (where 256 grey scale level values are represented by an 8 bit representation) shown in column 309 representing error involved in representing a 10 bit value of column 305 with the corresponding nearest 8 bit value of column 307.

System 10 advantageously represents the 10 bit grey scale pixel values of column 305 with the 8 bit pixel value of column 307 plus the R, G, B correction pixel bits of (Δr, Δg, Δb) of columns 311, 313 and 315 respectively. The additional Δr, Δg, Δb adjustment values of columns 311, 313 and 315 applied to R, G, B video channels respectively, change color imperceptibly but corrects for luminance. The total luminance value of the corrected 8 bit pixel value is shown in column 317 with each total luminance value being calculated by adding the bit pixel value of each row of column 307 to the sum 0.3r+0.59g+0.11b where r, g, b are the bit values of the corresponding rows in columns 311, 313 and 315 respectively. Column 319 shows number of bits of error (of a 10 bit value) involved in representing each 10 bit value of column 305 with the corresponding nearest uncorrected 8 bit value of column 307. Column 321 shows number of bits of error (of a 10 bit value) involved in representing each 10 bit value of column 305 with the corresponding nearest corrected 8 bit value of column 317. The system 10 correction substantially reduces luminance error as indicated by comparison of the values of columns 319 and 321.

Data processor 15 determines a difference between an input luminance value and a displayable bit value of an input bit length as indicated in columns 309 and 319. In response to the difference, processor 15 derives R, G, B pixel luminance values by allocating additional bits to the displayable bit value for the R, G, B pixel luminance values as shown in columns 311, 313, 315 to provide corrected R, G, B pixel luminance values representing the grey scale luminance value (column 317). Processor 15 outputs corrected R, G, B pixel luminance values for display on monitor 33. In an example, 8 bit monitor 33 displays 256 grey shades if the red, green, and blue display channels are set to the same value and system 10 provides approximately 10 bits of precision in grey shade. A 10-bit grey value of 502 is displayed as r=129, g=124, b=124, for example.

Figure 4:
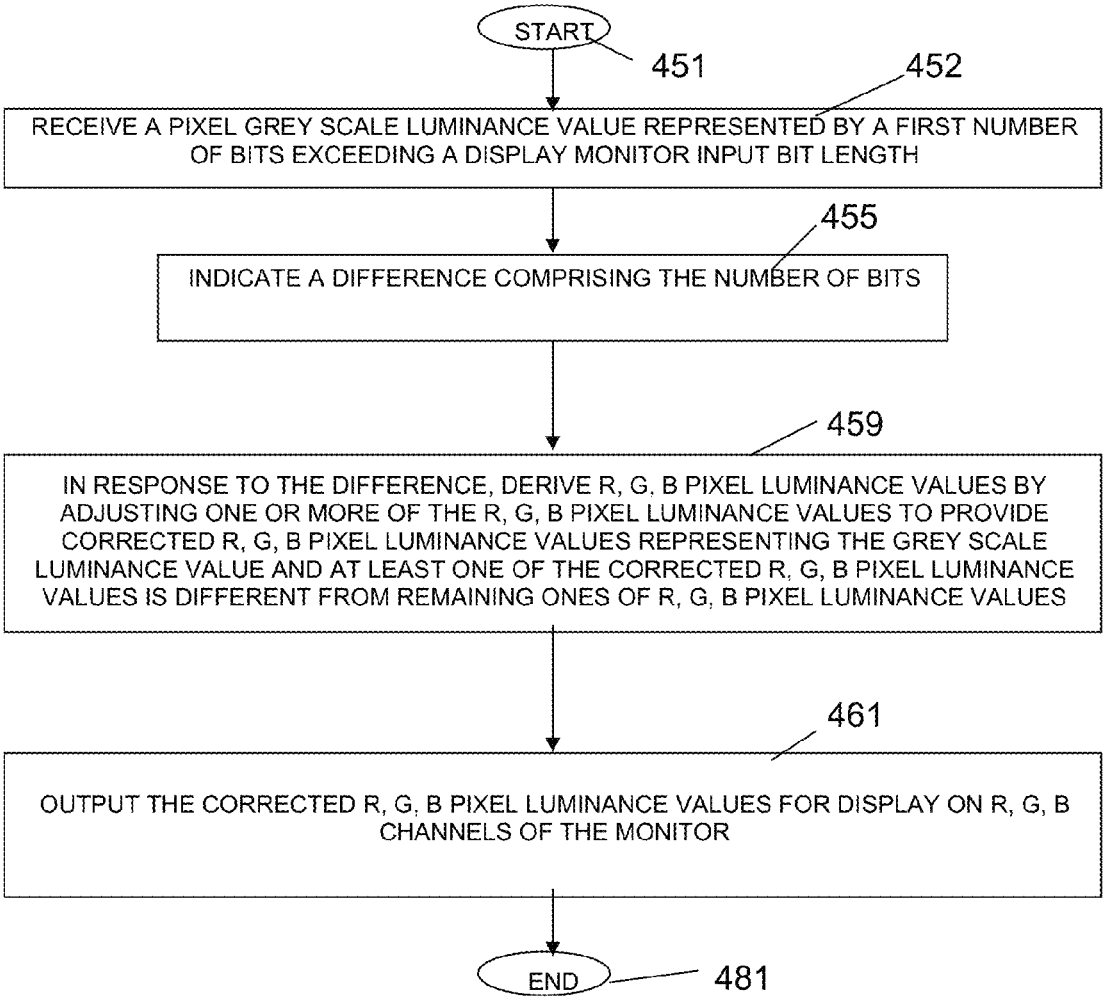
FIG. 4 shows a flowchart of a process used by a system enhancing reduced resolution grey scale luminance data for display on a monitor, according to invention principles.

FIG. 4 shows a flowchart of a process used by system 10 (FIG. 1) enhancing reduced resolution grey scale luminance data for display on (color) monitor 33. In step 452 following the start at step 451 interface 12 receives a pixel grey scale luminance value represented by a first number of bits exceeding a display monitor input bit length. In step 455, data processor 15 indicates a difference comprising the number of bits. In step 459, in response to the difference, data processor 15 derives one or more R, G, B pixel luminance values by adjusting one or more of the R, G, B pixel luminance values to provide corrected R, G, B pixel luminance values representing the grey scale luminance value and at least one of the corrected R, G, B pixel luminance values is different from remaining ones of R, G, B pixel luminance values.

Processor 15 adjusts two or less of the R, G, B pixel luminance values in response to a luminance function. In one embodiment the luminance function is of the form, $$\text{Luminance}=c1*R+c2*G+c3*B$$

where c1, c2, c3 are constants and R, G, B are red, green and blue pixel values. In another embodiment, the luminance function substantially comprises, $$L=0.3r+0.59g+0.11b.$$

In another embodiment, in response to the difference, data processor 15 derives one or more R, G, B pixel luminance values by incrementing two or less of the R, G, B pixel luminance values to provide corrected R, G, B pixel luminance values. In an embodiment, processor 15 increments the two or less of the R, G, B pixel luminance values by a single bit in response to a luminance function. Data processor 15 in step 461 outputs the corrected R, G, B pixel luminance values for display on R, G, B channels of monitor 33. The corrected R, G, B pixel luminance values representing the grey scale luminance value corrected for the difference are not all the same value. The process of FIG. 4 terminates at step 481.

A processor as used herein is a device for executing machine-readable instructions stored on a computer readable medium, for performing tasks and may comprise any one or combination of, hardware and firmware. A processor may also comprise memory storing machine-readable instructions executable for performing tasks. A processor acts upon information by manipulating, analyzing, modifying, converting or transmitting information for use by an executable procedure or an information device, and/or by routing the information to an output device. A processor may use or comprise the capabilities of a computer, controller or microprocessor, for example, and is conditioned using executable instructions to perform special purpose functions not performed by a general purpose computer. A processor may be coupled (electrically and/or as comprising executable components) with any other processor enabling interaction and/or communication therebetween. Computer program instructions may be loaded onto a computer, including without limitation a general purpose computer or special purpose computer, or other programmable processing apparatus to produce a machine, such that the computer program instructions which execute on the computer or other programmable processing apparatus create means for implementing the functions specified in the block (s) of the flowchart(s). A user interface processor or generator is a known element comprising electronic circuitry or software or a combination of both for generating display elements or portions thereof. A user interface comprises one or more display elements enabling user interaction with a processor or other device.

An executable application, as used herein, comprises code or machine readable instructions for conditioning the processor to implement predetermined functions, such as those of an operating system, a context data acquisition system or other information processing system, for example, in response to user command or input. An executable procedure is a segment of code or machine readable instruction, sub-routine, or other distinct section of code or portion of an executable application for performing one or more particular processes. These processes may include receiving input data and/or parameters, performing operations on received input data and/or performing functions in response to received input parameters, and providing resulting output data and/or parameters. A graphical user interface (GUI), as used herein, comprises one or more display elements, generated by a display processor and enabling user interaction with a processor or other device and associated data acquisition and processing functions.

The UI also includes an executable procedure or executable application. The executable procedure or executable application conditions the display processor to generate signals representing the UI display images. These signals are supplied to a display device which displays the elements for viewing by the user. The executable procedure or executable application further receives signals from user input devices, such as a keyboard, mouse, light pen, touch screen or any other means allowing a user to provide data to a processor. The processor, under control of an executable procedure or executable application, manipulates the UI display elements in response to signals received from the input devices. In this way, the user interacts with the display elements using the input devices, enabling user interaction with the processor or other device. The functions and process steps herein may be performed automatically or wholly or partially in response to user command. An activity (including a step) performed automatically is performed in response to executable instruction or device operation without user direct initiation of the activity. A histogram of an image is a graph that plots the number of pixels (on the y-axis herein) in the image having a specific intensity value (on the x-axis herein) against the range of available intensity values. The resultant curve is useful in evaluating image content and can be used to process the image for improved display (e.g. enhancing contrast).

The system and processes of FIGS. 1-4 are not exclusive. Other systems, processes and menus may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention. A system uses a standard monitor capable of displaying colors to display 8 bits of data per R, G, B channel to present greyscale images with greater than 8 bit effective pixel resolution comprising extended bit resolution facilitating physician detection of anatomical abnormalities. Further, the processes and applications may, in alternative embodiments, be located on one or more (e.g., distributed) processing devices on a network linking the units FIG. 1. Any of the functions and steps provided in FIGS. 1-4 may be implemented in hardware, software or a combination of both. No claim element herein is to be construed under the provisions of 35 U.S.C. 112, sixth paragraph, unless the element is expressly recited using the phrase "means for."

What is claimed is:

1. A system for representing grey scale luminance values on a monitor, comprising:

an interface for receiving a first grey scale luminance value of a first pixel, the first luminance value represented by a first number of bits;

a data processor for:

truncating a second number of bits from the first number of bits of the luminance value to generate a second luminance value represented by a third number of bits, wherein the third number of bits is an input bit length of the monitor;

determining an error based on a value of the truncated second number of bits, based on the determined error and on the second luminance value, determining a corrected luminance value for each of red, green and blue channels associated with the first pixel, wherein at least one of said corrected luminance values is different from remaining ones of said corrected luminance values; and displaying the first pixel on said monitor using said corrected luminance values for each of the red, green and blue channels associated with the first pixel.

2. The system according to claim 1, wherein said data processor determines a corrected luminance value for each of the red, green, and blue channels associated with the first pixel by adjusting the second luminance value said by a single bit based on a luminance function.

3. The system according to claim 2, wherein said luminance function is of the form, $$\text{Luminance}=c1*R+c2*G+c3*B$$

Where c1, c2, c3 are constants, and R, G, B are corrected luminance values for each of red, green and blue channels associated with the first pixel.

4. The system according to claim 3, wherein said luminance function substantially comprises, $$L=0.3R+0.59G+0.11B.$$

5. The system according to claim 1, wherein said monitor is a color monitor.

6. The system according to claim 1, wherein said data processor determines the corrected luminance value for each of the red, green and blue channels associated with the first pixel by adjusting the second luminance value.

7. A method for representing grey scale luminance values on a monitor, comprising the activities of:

receiving a first grey scale luminance value of a first pixel, the first luminance value represented by a first number of bits;

truncating a second number of bits from the first number of bits of the luminance value to generate a second luminance value represented by a third number of bits, wherein the third number of bits is an input bit length of the monitor;

determining an error based on a value of the truncated second number of bits;

based on the determined error and on the second luminance value, determining a corrected luminance value for each of red, green, and blue channels associated with the first pixel, wherein at least one of said corrected luminance values is different from remaining ones of said corrected luminance values; and displaying the first pixel on said monitor using said corrected luminance values for each of the red, green, and blue channels associated with the first pixel.

8. The method according to claim 7, including the activity of adjusting the second luminance value by a single bit based on a luminance function to determine a corrected luminance value for each of the red, green, and blue channels associated with the first pixel.

9. The method according to claim 8, wherein said luminance function is of the form, $$\text{Luminance}=c1*R+c2*G+c3*B$$

Where c1, c2, c3 are constants, and R, G, B are corrected luminance values for each of red, green and blue channels associated with the first pixel.

10. The method according to claim 9, wherein said luminance function substantially comprises, $$L=0.3R+0.59G+0.11B.$$

11. The method according to claim 7, including the activity of adjusting the second luminance values to determine the corrected luminance value for each of the red, green, and blue channels associated with the first pixel and wherein said monitor is a color monitor.

* * * * *